United States Patent [19]

Tabb

[11] Patent Number: 4,959,286

[45] Date of Patent: Sep. 25, 1990

[54] TWO-PASS HIGHLIGHT COLOR IMAGING WITH DEVELOPER HOUSING BIAS SWITCHING

[75] Inventor: Charles H. Tabb, Penfield, N.Y.

[73] Assignee: Xerox Corporation, Stamford, Conn.

[21] Appl. No.: 332,087

[22] Filed: Apr. 3, 1989

[51] Int. Cl.[5] ..... G03G 13/08

[52] U.S. Cl. ..... 430/45; 355/326

[58] Field of Search ..... 430/42, 54, 31, 45; 355/326

[56] References Cited

U.S. PATENT DOCUMENTS

| | | | |
|---|---|---|---|
| 4,078,929 | 3/1978 | Gundlach | 96/1.2 |
| 4,562,129 | 12/1985 | Tanaka et al. | 430/54 |
| 4,810,604 | 3/1989 | Schmidlin | 430/54 |

*Primary Examiner*—John L. Goodrow

[57] ABSTRACT

Imaging method and apparatus utilizing some of the features of both single and two pass highlight color imaging. Both developer housings are always actively engaged. One housing is used for charged area development (CAD) and the other is used for discharged area development (DAD). The developer housing biases are switched or adjusted in order to preclude unwanted image development. When the DAD image moves through the CAD housing the CAD bias is switched to bias away the developer in the CAD developer housing. Likewise, when the CAD image moves through the DAD housing its bias will be switched to bias away the DAD developer.

10 Claims, 3 Drawing Sheets

TWO-PASS HIGHLIGHT COLOR IMAGING WITH DEVELOPER HOUSING BIAS SWITCHING

BACKGROUND OF THE INVENTION

This invention relates generally to highlight color imaging and more particularly to two-pass highlight color imaging.

In the practice of conventional xerography, it is the general procedure to form electrostatic latent images on a xerographic surface by first uniformly charging a charge retentive surface such as a photoreceptor. Only the imaging area of the photoreceptor is uniformly charged. The image area does not extend across the entire width of the photoreceptor. Accordingly, the edges of the photoreceptor are not charged. The charged area is selectively dissipated in accordance with a pattern of activating radiation corresponding to original images. The selective dissipation of the charge leaves a latent charge pattern on the imaging surface corresponding to the areas not exposed by radiation.

This charge pattern is made visible by developing it with toner by passing the photoreceptor past a single developer housing. The toner is generally a colored powder which adheres to the charge pattern by electrostatic attraction. The developed image is then fixed to the imaging surface or is transferred to a receiving substrate such as plain paper to which it is fixed by suitable fusing techniques.

In tri-level, highlight color imaging, unlike conventional xerography, the image area contains three voltage levels which correspond to two image areas and to a background voltage area. One of the image areas corresponds to non-discharged (i.e. charged areas) of the photoreceptor while the other image areas correspond to discharged areas of the photoreceptor. The charged areas are developed using Charged Area Development (CAD) while the discharged areas are developed using Discharged Area Development (DAD).

The concept of tri-level, highlight color xerography is described in U.S. Pat. No. 4,078,929 issued in the name of Gundlach. The patent to Gundlach teaches the use of tri-level xerography as a means to achieve single-pass highlight color imaging. As disclosed therein the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development systems are biased to about the background voltage. Such biasing results in a developed image of improved color sharpness.

In highlight color xerography as taught by Gundlach, the xerographic contrast on the charge retentive surface or photoreceptor is divided three, rather than two, ways as is the case in conventional xerography. The photoreceptor is charged, typically to 900 v. It is exposed imagewise, such that one image corresponding to charged image areas (which are subsequently developed by charged-area development, i.e. CAD) stays at the full photoreceptor potential ($V_{cad}$ or $V_{ddp}$, shown in FIG. 1*a*). The other image is exposed to discharge the photoreceptor to its residual potential, i.e. $V_{dad}$ or $V_c$ (typically 100 v) which corresponds to discharged area images that are subsequently developed by discharged-area development (DAD) and the background areas exposed such as to reduce the photoreceptor potential to halfway between the $V_{cad}$ and $V_{dad}$ potentials, (typically 500 v) and is referred to as $V_{white}$ or $V_w$. The CAD developer is typically biased about 100 v ($V_{bb}$, shown in FIG. 1*b*) closer to $V_{cad}$ than $V_{white}$ (about 600 v), and the DAD developer system is biased about 100 v ($V_{cb}$, shown in FIG. 1*b*) closer to $V_{dad}$ than $V_{white}$ (about 400 v).

Another method of highlight color imaging is the two-pass technique. In the two-pass system the charge retentive surface is moved through the processing stations twice. In two-pass highlight color imaging it is necessary to render development inoperative in the inter-document gap in order to avoid certain development problems. Single pass schemes like the tri-level concept of Gundlach discussed above avoid the requirement of rendering the development inoperative in the inter-document gap by keeping both development systems engaged or operative and using suitably biased, opposite polarity developer to develop both images sequentially within the same frame. The trade-off using tri-level imaging in lieu of two-pass imaging is the necessity of imaging three light levels within one frame (i.e. black, white and color) thereby cutting the voltage latitude in half or more. This necessitates using a high gamma development system like conductive mag brush (CMB). In two-pass highlight color imaging, the full contrast voltage is substantially available for each of the two images.

Present two-pass system concepts have either had to cam development housings in and out within the inter-document gap or else keep both housings in the development zone but turn the flow of developer off and the other one on in the gap. These approaches either produce mechanical problems that limit the process speed or else necessitate very high tolerances which may become formidable especially with an insulative magnetic brush development system where the charge retentive surface is wrapped partly around the developer rolls.

BRIEF SUMMARY OF THE INVENTION

Briefly, the present invention obviates the problems noted above by utilizing some of the features of both single and two pass highlight color imaging. Both developer housings are always actively engaged. There is no mechanical switching or movement of the housings. One housing is used for charged area development (CAD) and the other is used for discharged area development (DAD). In the present invention, the developer housing biases are switched. When the DAD image moves through the CAD housing the CAD bias is switched to bias away the developer in the CAD developer housing. Likewise, when the CAD image moves through the DAD housing its bias will be switched to bias away the DAD developer. Otherwise, the CAD background images would develop as solid areas in the DAD developer housing and vice versa.

DETAILED DESCRIPTION OF THE PREFERRED EMBODIMENT OF THE INVENTION

Figure 1A:
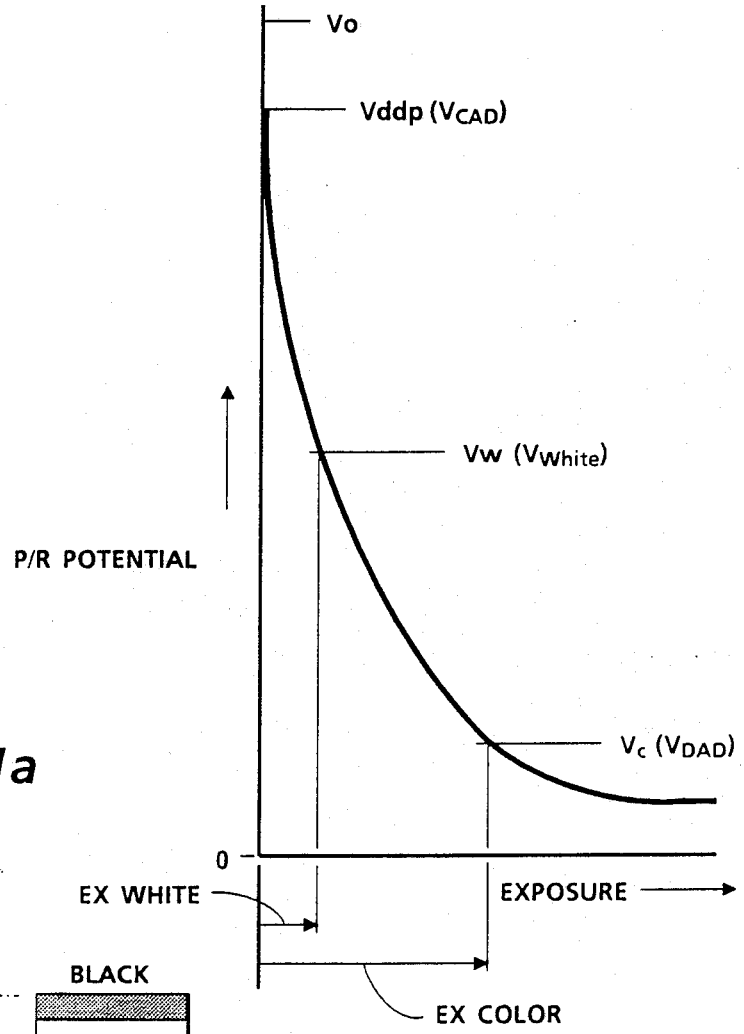
FIG. 1*a* is a plot of photoreceptor potential versus exposure illustrating a tri-level electrostatic latent image.
Figure 1B:
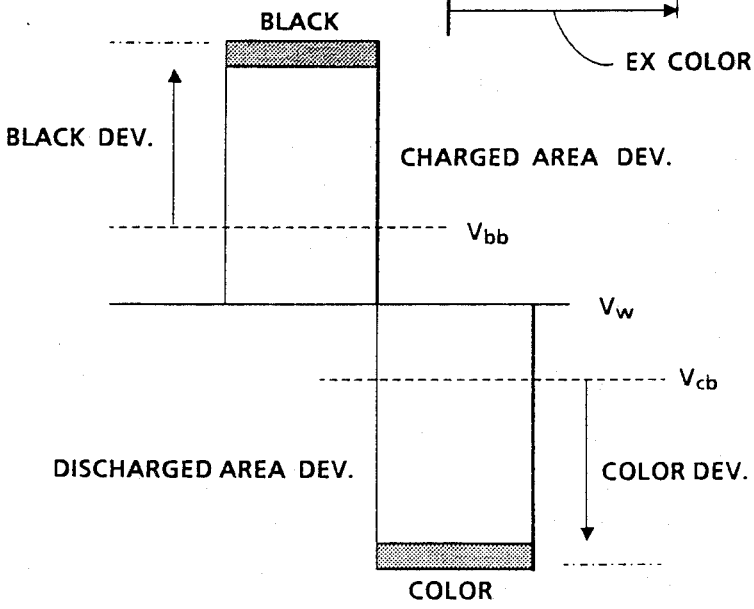
FIG. 1*b* is a plot of photoreceptor potential illustrating single-pass, highlight color latent image characteristics.
Figure 2:
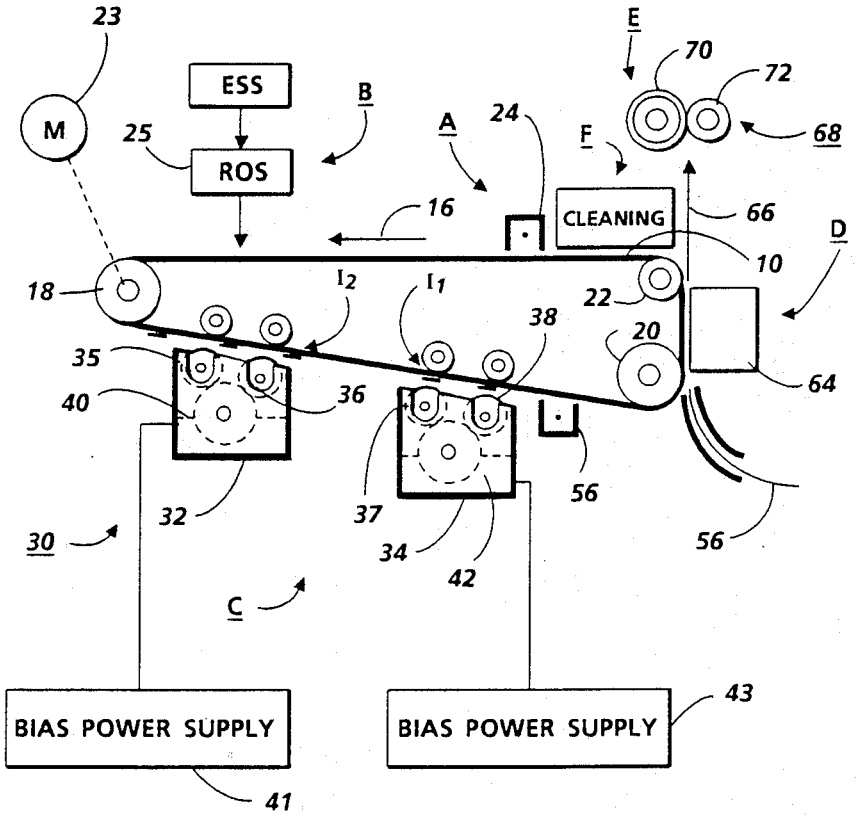
FIG. 2 is schematic illustration of a printing apparatus incorporating the inventive features of the invention.
Figure 3A:
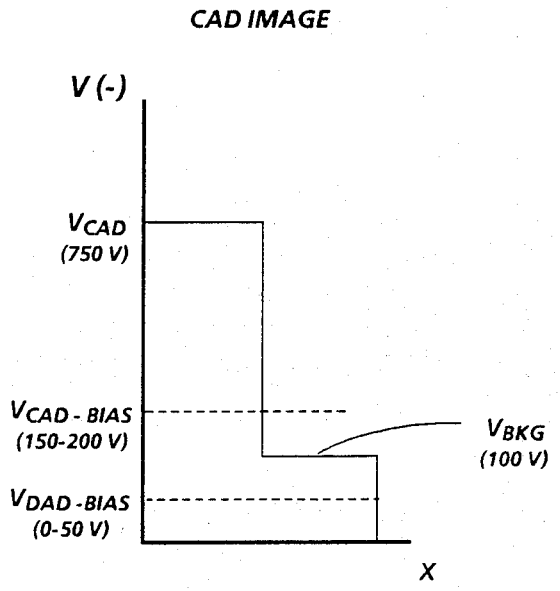
FIG. 3*a* illustrates the voltage profile of a CAD image and associated development bias voltages.
Figure 3B:
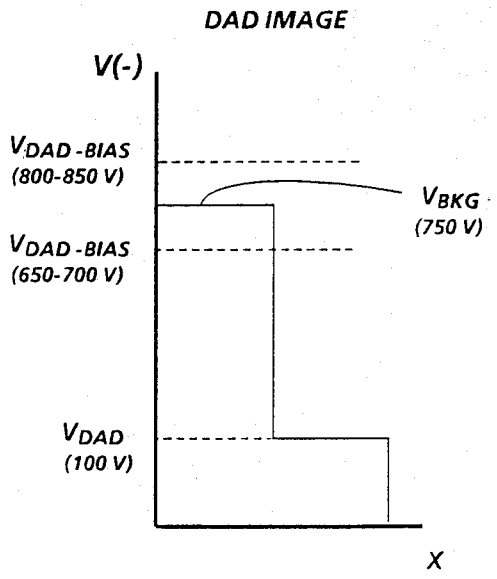
FIG. 3*b* illustrates the voltage profile for a DAD image and associated development bias voltages.

As shown in FIG. 2, a printing machine incorporating the invention may utilize a charge retentive member in the form of a photoconductive belt 10 consisting of a photoconductive surface and an electrically conductive substrate and mounted for movement past a charging station A, an exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 2, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential, $V_0$. Any suitable control, well known in the art, may be employed for controlling the corona discharge device 24.

Next, the charged uniformly portions of the photoreceptor surface are advanced through exposure station B. At exposure station B, the uniformly charged photoreceptor or charge retentive surface 10 is exposed to a laser based output scanning device 25 which causes the charge retentive surface to be discharged in accordance with the output from the scanning device. Preferably the scanning device is a two level laser Raster Output Scanner (ROS).

During the imaging process two images are sequentially created on successive portions of the photoreceptor 10. A first image $I_1$ image is represented by charged and discharged areas, the former being image areas and the latter being background areas on the photoreceptor. The other image, $I_2$ is represented by charged and discharged areas, the former being background areas and the latter being image areas. The two images are subsequently developed by charged area development (CAD) and discharged area development (DAD) and sequentially transferred to a final substrate such as plain paper. Thus, for each image formed on the final substrate there are two images formed on the photoreceptor which are then transferred to the substrate.

The photoreceptor, which is initially charged to a voltage $V_0$, undergoes dark decay to a level $V_{CAD}$ equal to about −750 volts. When exposed at the exposure station B the image areas remain at −750 volts while the background areas are discharged to a background voltage ($V_{bkg}$=a negative 100 volts). This results in the formation of the image $I_1$. For image $I_2$, the photoreceptor is discharged to a voltage level $V_{DAD}$ equal to about −100 volts in the image areas while the background areas, $V_{bkg}$ remain at −750 volts.

At development station C, a development system, indicated generally by the reference numeral 30 advances developer materials into contact with the electrostatic latent images. The development system 30 comprises first and second developer apparatuses 32 and 34.

The developer apparatus 32 comprises a housing containing a pair of magnetic brush rollers 35 and 36. The rollers advance developer material 40 into contact with the photoreceptor for developing the charged areas of image $I_1$. The developer material 40 by way of example contains positively charged black toner. Electrical biasing is accomplished via power supply 41 electrically connected to developer apparatus 32. A DC bias of approximately −150 to −200 volts is applied to the rollers 35 and 36 via the power supply 41 when image $I_1$ passes through the development zone between the development apparatus 32 and the photoreceptor. When image $I_2$ passes through this development zone the bias on the development apparatus 32 is switched to a voltage level of −800 to −850 volts to thereby preclude development of that image.

The developer apparatus 34 comprises a housing containing a pair of magnetic brush rolls 37 and 38. The rollers advance developer material 42 into contact with the photoreceptor for developing the discharged-area images of $I_2$. The developer material 42 by way of example contains negatively charged red toner for developing the discharged-area images. Appropriate electrical biasing is accomplished via power supply 43 electrically connected to developer apparatus 34. A suitable DC bias of approximately −650 to −700 volts is applied to the rollers 37 and 38 via the bias power supply 43 when image $I_2$ passes through the development zone between the development apparatus 34 and the photoreceptor. When image $I_1$ passes this development zone the bias on the development apparatus 34 is switched to −0 to −50 volts to thereby preclude development of that image.

A sheet of support material 58 is moved into contact with the toner images at transfer station D. The sheet of support material is advanced to transfer station D by conventional sheet feeding apparatus, not shown. Preferably, the sheet feeding apparatus includes a feed roll contacting the uppermost sheet of a stack copy sheets. Feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station D.

At the transfer station, two images, $I_1$ and $I_2$ are sequentially transferred to a support sheet 58 to form the final image. Any suitable transfer device 64 is used for effecting sequential transfer of the images, $I_1$ and $I_2$ to the support sheet 58. The transfer device 64 causes the support to contact the photoreceptor a first time for transferring the image $I_1$ and a second time for transfer of image $I_2$.

After transfer, the sheet continues to move, in the direction of arrow 66, onto a conveyor (not shown) which advances the sheet to fusing station E.

Fusing station E includes a fuser assembly, indicated generally by the reference numeral 68, which permanently affixes the transferred powder images to a copy substrate 60. Preferably, fuser assembly 68 comprises a heated fuser roller 70 and a backup roller 72. Sheet 60 passes between fuser roller 70 and backup roller 72 with the toner powder image contacting fuser roller 70. In this manner, the toner powder images are permanently affixed to sheet 60. After fusing, a chute, not shown, guides the advancing sheet 60 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F. A magnetic brush cleaner housing is disposed at the cleaner station F. The cleaner apparatus comprises a conventional magnetic brush roll structure for causing carrier particles in the cleaner housing to form a brush-like orientation relative to the roll structure and the charge retentive surface. It also includes a pair of detoning rolls for removing the residual toner from the brush. Other cleaners such as a fur brush are also contemplated.

Subsequent to cleaning, a discharge lamp (not shown) floods the photoconductive surface with light to dissipate any residual electrostatic charge remaining prior to the charging thereof for the successive imaging cycle.

What is claimed is:

1. The method of forming images, said method including the steps of:

uniformly charging a charge retentive surface to a predetermined voltage level;

forming, on said charge retentive surface at different locations thereof, first image and second latent electrostatic images;

moving said first and second latent electrostatic images sequentially through two developer housings having different kinds of toner contained therein;

electrically biasing said one of said developer housings at a first bias level when one of said images passes therethrough and at a second level as the other of said images passes therethrough whereby development of said said one of said images is effected and development of said other images is precluded; and electrically biasing the other of said developer housings at a first level when said one of said images passes therethrough and at a second level when said other of said images passes therethrough whereby development of said other image is effected and development of said one image is precluded.

2. The method according to claim 1 wherein said toners are different colors.

3. The method according to claim 2 wherein said one of said images comprises a charged area image and the other of said images comprises a discharged area image.

4. The method according to claim 3 wherein said charged area image is at a voltage level of approximately −750 volts and electrical biasing of said one of said developer housings is accomplished in the range of −150 to −200 volts when said one of said images passes through said one of said developer housings and electrical biasing of said one developer housing is accomplished in the range of −800 to −850 volts when said other of said images passes through said one of said developer housings.

5. The method according to claim 4 wherein said discharged area image is at a voltage level of approximately −100 volts and electrical biasing of said other of said developer housings is accomplished in the range of −650 to −700 volts when said other of said images passes through said other of said developer housings and electrical biasing of said other developer housing is accomplished in the range of −0 to −50 volts when said one of said images passes through said said other of said developer housings.

6. Apparatus for forming images, said apparatus comprising:

uniformly charging a charge retentive surface to a predetermined voltage level;

means for forming first image and second latent electrostatic images on a charge retentive surface at different locations thereof;

means for moving said first and second latent electrostatic images sequentially through two developer housings having different kinds of toner contained therein;

means for electrically biasing said one of said developer housings at a first bias level when one of said images passes therethrough and at a second level as the other of said images passes therethrough whereby development of said said one of said images is effected and development of said other images is precluded; and means for electrically biasing the other of said developer housings at a first level when said one of said images passes therethrough and at a second level when said other of said images passes therethrough whereby development of said other image is effected and development of said one image is precluded.

7. Apparatus according to claim 6 wherein said toners are different colors.

8. Apparatus according to claim 7 wherein said one of said images comprises a charged area image and the other of said images comprises a discharged area image.

9. Apparatus according to claim 8 wherein said charged area image is at a voltage level of approximately −750 volts and electrical biasing of said one developer housings is accomplished in the range of −150 to −200 volts when said one of said images passes through said one of said developer housings and electrical biasing of said one of said developer housing is accomplished in the range of −800 to −850 volts when said other of said images passes through said one of said developer housings.

10. Apparatus according to claim 9 wherein said discharged area image is at a voltage level of approximately −100 volts and electrical biasing of said other of said developer housings is accomplished in the range of −650 to −700 volts when said other of said images passes through said other of said developer housings and electrical biasing of said other developer housing is accomplished in the range of −0 to −50 volts when said one of said images passes through said other of said developer housings.

* * * * *